US011371457B2

(12) United States Patent
Vogel et al.

(10) Patent No.: US 11,371,457 B2
(45) Date of Patent: Jun. 28, 2022

(54) DEVICE AND METHOD FOR CHECKING SAFETY-RELEVANT SWITCH-OFF PATHS IN CONTROL UNITS DURING ONGOING ENGINE OPERATION

(71) Applicant: Robert Bosch GmbH, Stuttgart (DE)

(72) Inventors: Andre Vogel, Boeblingen (DE); Christian Ruland, Remshalden (DE); Sven Faehnle, Sachsenheim (DE); Wolfgang Haag, Winnenden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/047,790

(22) PCT Filed: Jun. 6, 2019

(86) PCT No.: PCT/EP2019/064745
§ 371 (c)(1),
(2) Date: Oct. 15, 2020

(87) PCT Pub. No.: WO2019/238515
PCT Pub. Date: Dec. 19, 2019

(65) Prior Publication Data
US 2021/0372339 A1 Dec. 2, 2021

(30) Foreign Application Priority Data
Jun. 11, 2018 (DE) ..... 102018209245.1

(51) Int. Cl.
*F02D 41/22* (2006.01)
*F02D 41/20* (2006.01)

(52) U.S. Cl.
CPC ..... *F02D 41/22* (2013.01); *F02D 41/20* (2013.01); *F02D 2041/2024* (2013.01)

(58) Field of Classification Search
CPC ... F02D 41/22; F02D 41/20; F02D 2041/2024
USPC ..... 123/436; 701/102–107, 110; 73/114.04, 73/114.22, 114.25, 114.26
See application file for complete search history.

(56) References Cited

U.S. PATENT DOCUMENTS 10,330,038 B2 * 6/2019 Baehner ..... F02D 41/2432

FOREIGN PATENT DOCUMENTS

| | | | |
|---|---|---|---|
| DE | 3732718 | A1 | 4/1989 |
| DE | 3838267 | A1 | 5/1990 |
| DE | 3925881 | A1 | 2/1991 |
| DE | 19604736 | A1 | 8/1997 |
| DE | 10152273 | A1 | 5/2003 |
| DE | 102004020539 | B3 | 7/2005 |
| DE | 102010015095 | A1 | 10/2011 |

OTHER PUBLICATIONS

International Search Report for PCT/EP2019/064745, dated Aug. 26, 2019.

* cited by examiner

*Primary Examiner* — Hai H Huynh
(74) *Attorney, Agent, or Firm* — Norton Rose Fulbright US LLP; Gerard Messina

(57) ABSTRACT

A device and a method for checking switch-off paths in control units of internal combustion engines during ongoing engine operation.

2 Claims, 4 Drawing Sheets

DEVICE AND METHOD FOR CHECKING SAFETY-RELEVANT SWITCH-OFF PATHS IN CONTROL UNITS DURING ONGOING ENGINE OPERATION

BACKGROUND INFORMATION

In engine control units of internal combustion engines, the torque-determining activations are carried out by a microcontroller (pC). The microcontroller activates a hardware circuit connected downstream via several output ports. The hardware circuit preferably includes ASICs and/or output stages that activate the injectors of the internal combustion engines. For safety purposes, redundant switch-off paths must be available in the event of an error, to ensure a safe state. The switch-off paths must be checked for functionality at least once every driving cycle. Since corresponding checks cause a short interruption in the engine activations as a result of system design, they may only be carried out in an interference-free manner prior to engine start, during the run-up or follow-up of the control unit.

Checks of this type are usually not carried out in stationary operated engines or in large-scale diesel applications, since these are operated continuously in most cases.

In the case of these applications, it is therefore not considered to be sufficient to carry out the checks once during the run-up of the control units.

SUMMARY

The present invention provides a possibility of carrying out a switch-off path test during ongoing operation, without the user being aware of a noticeable effect. The switch-off path test is carried out independently of an engine start in shorter time intervals. This may have the advantage that the safety is significantly increased, since a dormant error may be detected in a shorter period of time and a suitable error response may be carried out earlier.

In accordance with an example embodiment of the present invention, a device and a method are provided that include ascertaining a suitable point in time as a function of the clock, of the phase, and/or of the rotational speed of the internal combustion engine. The switch-off path test is then carried out within a time window, in which the components of the internal combustion engine are not activated. In the event of an error, the check should be repeated in a defined time interval from the next check to prevent the rotational speed from dropping.

An object of the present invention is to make the implementation of a switch-off path test possible that is largely interference-free and may be carried out in regular intervals during ongoing engine operation and may thus also be carried out in shorter time intervals independently of the engine start and may thus meet the safety requirements. The switch-off path test may be carried out during ongoing operation with the aid of this present invention. The switch-off path test may thus be carried out independently of an engine start in shorter time intervals. This has the advantage that the safety is increased, since a dormant error may be detected in a shorter period of time and a suitable error response may be carried out earlier. Furthermore, this results in shorter run-up times of the control unit, since the test no longer has to be carried out at the beginning of each driving cycle.

BRIEF DESCRIPTION OF THE DRAWING

Exemplary embodiments of the present invention are illustrated in the figures and explained in greater detail below.

DETAILED DESCRIPTION OF EXAMPLE EMBODIMENTS

Figure 1:
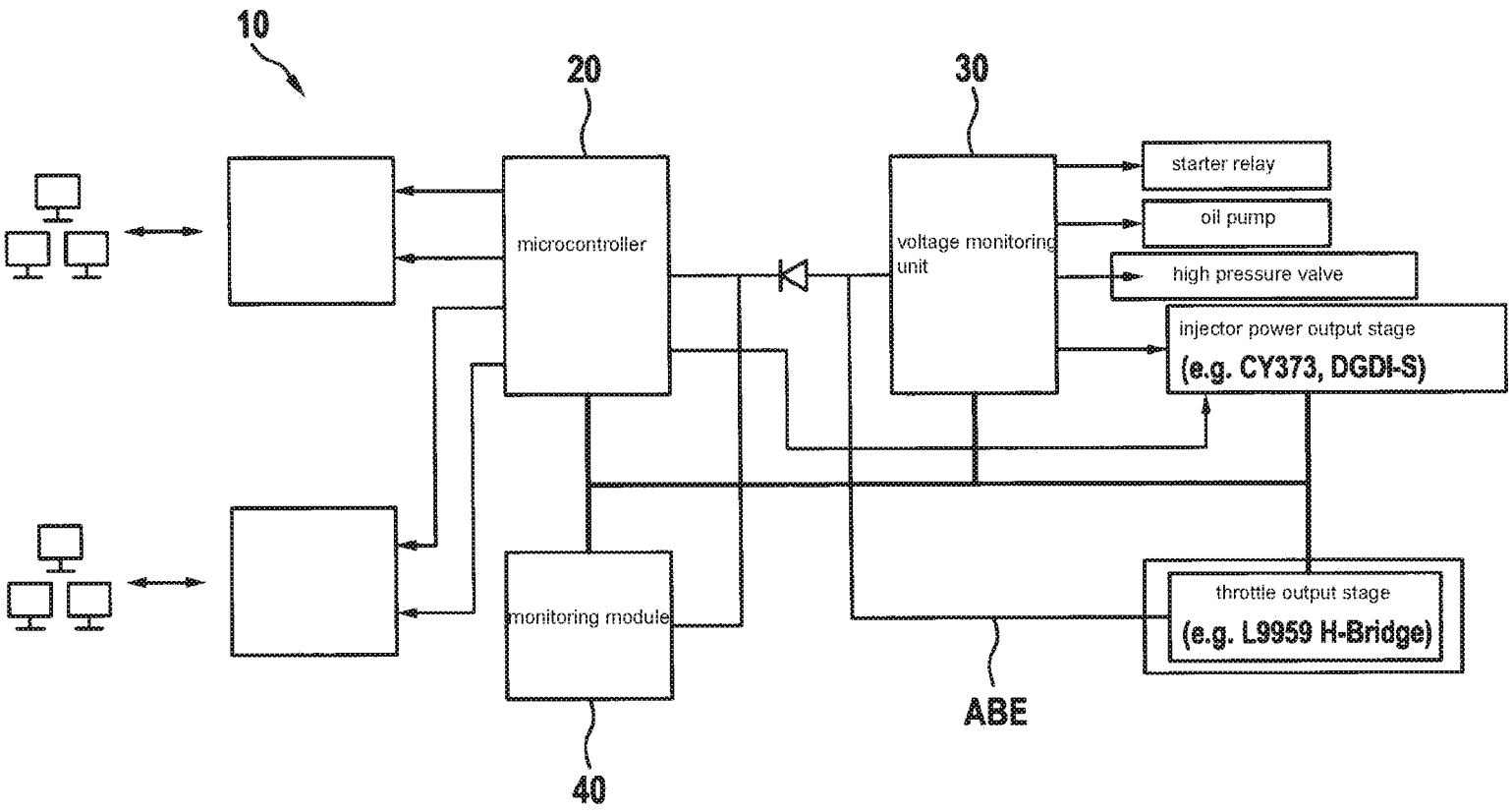
FIG. 1 shows a circuit diagram of one exemplary embodiment of the circuit according to the present invention.

FIG. 1 shows a device 10 for checking the switch-off paths in the control units of internal combustion engines. Circuit 10 includes a microcontroller 20. The microcontroller is provided to control the engine management functions of an internal combustion engine. A voltage monitoring unit 30 monitors the voltage in the control unit. A monitoring module 40 is provided to monitor at least one state. Furthermore, circuit 10 includes three possible switch-off paths. These are "switch-off via ABE" (controlled by voltage monitoring unit 30), "switch-off via WDA" (controlled by monitoring module 40), and "switch-off via error pin" (controlled by microcontroller 20). The switch-off path test includes several test steps. If the test steps are processed sequentially, the total duration of the switch-off path test is 20 ms to 40 ms. The deactivation of the output stages takes only 2.2 ms to 4.4 ms per test step. The object of the present invention is to carry out the deactivation during ongoing engine operation. However, the deactivation is carried out within a time window, in which no torque-relevant activations take place.

In engines having a number of cylinders ≤6, a sufficiently great time window is to be found without torque-relevant activations at low rotational speeds. The time window is in this case ≤4.4 ms at rotational speeds <2,000 rpm. The deactivation of the output stages may be carried out in this case between two torque-relevant activations, without the torque-relevant activations themselves being affected. In engines having a small number of cylinders, it is necessary to suppress interruptions of torque-relevant activations, since this makes them more prone to a drop in the rotational speed than larger engines.

In engines having a number of cylinders >6, a failed torque-relevant activation has a smaller effect on the rotational speed, since these engines run more smoothly. The point in time of the gap is a function of the number of cylinders and the angle range, in which the torque-relevant activations take place. The time span, during which the test is started, must therefore be applied.

Figure 2:
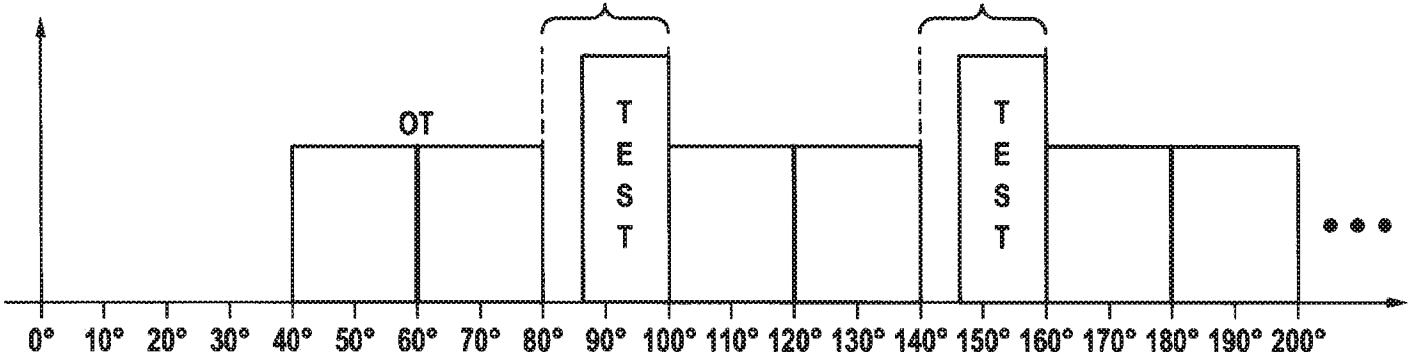
FIG. 2 shows a time profile of a test step.

FIG. 2 shows the time profile of a test step in an injection gap. It must be ensured that the test is carried out regularly to discover dormant errors. The time between two complete tests must be applied and may be established according to the application and the safety requirements. The time between two complete tests must be determined as a function of the application. The latter is effected by the duration between "engine on" and "engine off" and the failure rates of the components involved (microcontroller 20, voltage monitoring unit 30, and monitoring module 40).

The time between the individual test steps is applicable with the aid of a suitable application tool (for example *INCA*). The exact value must be determined in the project-specific context; it must be selected in such a way that all test steps are completed before the new test cycle (time between two complete tests) starts. The time between the test steps is necessary to avoid relevant drops in the rotational speed, in the event that a torque-relevant activation is indeed prevented as a result of the test.

Figure 3:
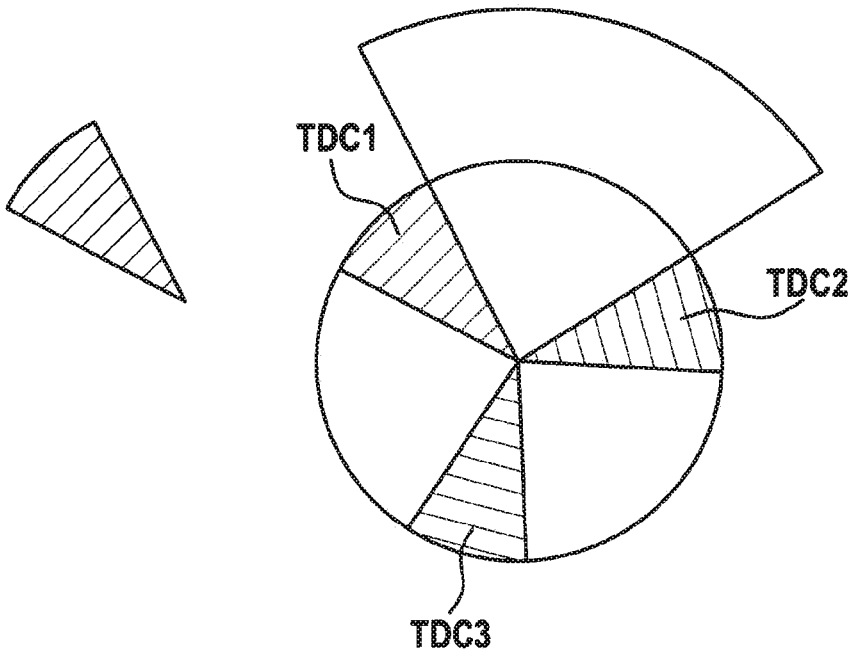
FIG. 3 shows angle ranges in which injections/ignitions may be active.

The angle ranges, in which injections/ignitions may be active, are known in the project-specific context, see FIG. 3.

Figure 4:
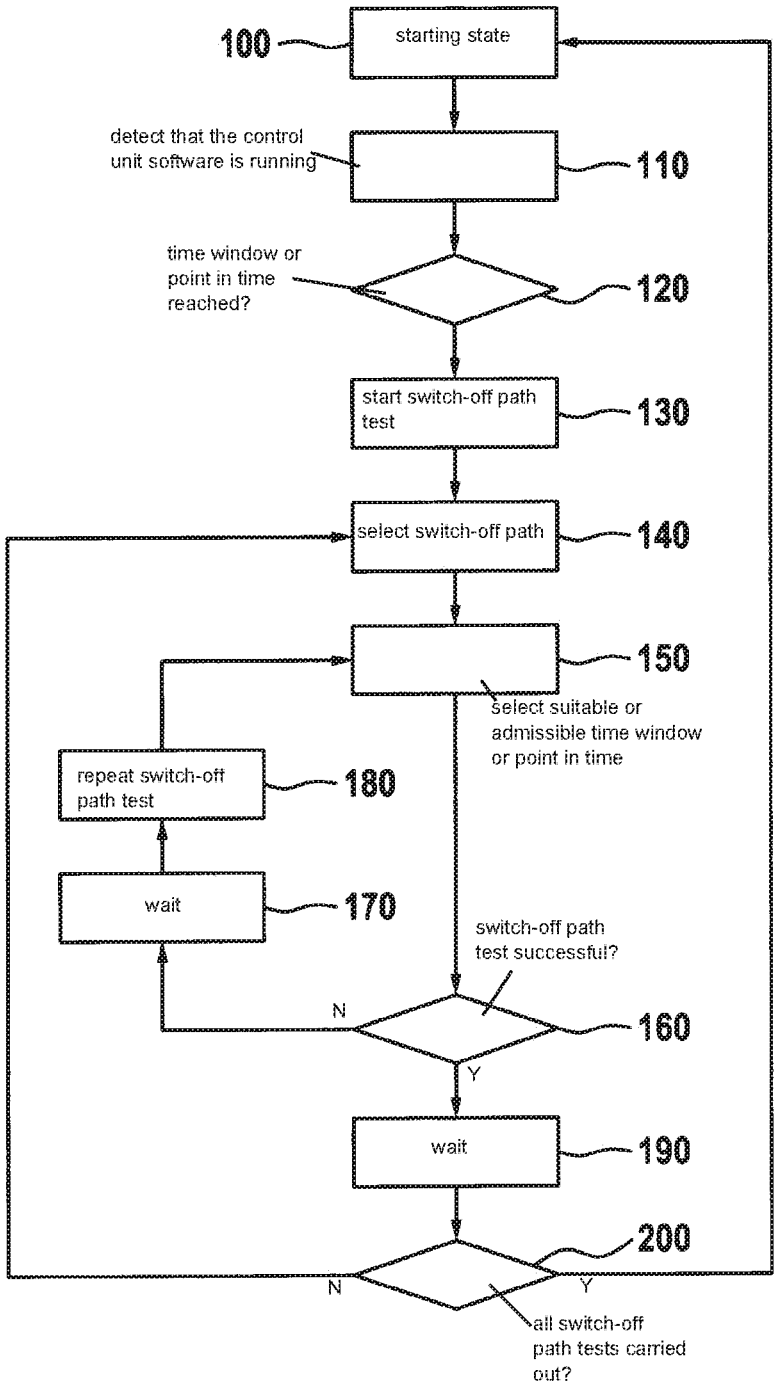
FIG. 4 shows a flowchart of one exemplary embodiment of the method according to the present invention.

FIG. 4 shows a method in accordance with an example embodiment of the present invention for checking switch-off paths in control units of internal combustion engines during ongoing engine operation, including at least the following steps:

ascertaining a suitable or admissible time window or point in time as a function of the clock and/or of the phase and/or of the rotational speed of the internal combustion engine carrying out the switch-off path test within a time window, in which the components of the internal combustion engine are not activated repeating the check in the event of an error within a defined time interval from the next check in order to prevent the rotational speed from dropping.

In state 100, the method is in its starting state. In 110, it is detected that the control unit software is running. If it is detected in method step 120 that an admissible time window or point in time is reached, the switch-off path test is started in 130. In 140, the switch-off path is selected.

There is a fixedly defined sequence, in which the tests are carried out.

Sequence:

1. Test "switch-off via WDA"
2. Test "switch-off via error pin"
3. Test "switch-off via ABE"

In 150, a suitable or admissible time window or point in time is selected as a function of the clock and/or of the phase and/or of the rotational speed of the internal combustion engine. In 160, it is checked, whether the test for the selected switch-off path was successful. If the test for the selected switch-off path was not successful, a certain time is waited in 170 to stabilize the combustion. In 180, the switch-off path test is then repeated.

If the test for the selected switch-off path in step 160 was successful, a certain time is waited in 190 to stabilize the combustion. In step 200, it is checked whether all switch-off path tests were carried out. In the case of a positive result, the method starts again with step 110. In the case of a negative result, the method starts again with step 140.

What is claimed is:

1. A device for checking switch-off paths in a control unit of an internal combustion engine during ongoing engine operation, comprising:

a microcontroller configured to control engine management functions of the internal combustion engine;

a voltage monitoring unit configured to monitor a voltage in the control unit;

a monitoring module configured to monitor at least one state; and three switch-off paths including (i) a switch-off via ABE which is controlled by the voltage monitoring unit, (ii) a switch-off via WDA which is controlled by the monitoring module, and (iii) a switch-off via error pin which is controlled by the microcontroller.

2. A method for checking switch-off paths in a control unit of an internal combustion engines during ongoing engine operation, comprising;

ascertaining a suitable or admissible time window, as a function of at least one of a clock, a phase or a rotational speed of the internal combustion engine;

carrying out a switch-off path test within the time window, the time window being a time window in which components of the internal combustion engine are not activated; and repeating the switch-off path test in the event of an error within a defined time interval to a next check to prevent the rotational speed from dropping, wherein a sequence in which the tests are carried out includes (i) testing a switch-off via WDA, (ii) testing a switch-off via error pin and (iii) testing a switch-off via ABE.

* * * * *